US007832134B2

(12) United States Patent
Fu et al.

(10) Patent No.: US 7,832,134 B2
(45) Date of Patent: Nov. 16, 2010

(54) UNDERWATER GUN COMPRISING A TURBINE-BASED BARREL SEAL

(75) Inventors: Jyun-Horng Fu, Centreville, VA (US); Robert James Howard, Clifton, VA (US); Antonio Paulic, Arlington, VA (US); John W. Rapp, Manassas, VA (US)

(73) Assignee: Lockheed Martin Corporation, Bethesda, MD (US)

( * ) Notice: Subject to any disclaimer, the term of this patent is extended or adjusted under 35 U.S.C. 154(b) by 281 days.

(21) Appl. No.: 12/165,090

(22) Filed: Jun. 30, 2008

(65) Prior Publication Data

US 2010/0251589 A1 Oct. 7, 2010

(51) Int. Cl.
*F41C 9/06* (2006.01)

(52) U.S. Cl. ..... 42/1.14; 89/1.809; 89/1.81; 89/5; 89/31; 114/316

(58) Field of Classification Search ..... 42/1.14; 89/1.809, 1.81, 5, 31; 114/316, 18, 19
See application file for complete search history.

(56) References Cited

U.S. PATENT DOCUMENTS 1,186,023 A * 6/1916 Moore ..... 89/31
3,298,278 A * 1/1967 Barakauskas ..... 89/1.8
5,639,982 A 6/1997 Cipolla
5,648,631 A 7/1997 Kirschner et al.
5,687,501 A * 11/1997 Stace et al. ..... 42/1.14
5,746,018 A 5/1998 Kirschner et al.
5,918,307 A * 6/1999 Cipolla ..... 89/1.81
5,966,858 A 10/1999 Curtis et al.
6,305,263 B1 * 10/2001 Wallin ..... 89/5
6,701,819 B1 3/2004 Williams et al.
7,237,353 B1 7/2007 Beauchamp et al.

* cited by examiner

*Primary Examiner*—J. Woodrow Eldred
(74) *Attorney, Agent, or Firm*—DeMont & Breyer, LLC

(57) ABSTRACT

An apparatus and method for sealing the barrel of an underwater gun between firings is disclosed. The apparatus comprises a turbine that is disposed at the outlet of the muzzle of the gun. The turbine draws in water and, in various embodiments, either (a) vaporizes it, forming a vapor barrier along the spin axis that keeps water out of the barrel, (b) expels it radially, thereby re-directing it so that it does not enter the barrel, or (c) generates water jets that prevent water from entering the barrel.

20 Claims, 4 Drawing Sheets

UNDERWATER GUN COMPRISING A TURBINE-BASED BARREL SEAL

CROSS REFERENCE TO RELATED APPLICATIONS

This case is related to the following U.S. patent application Ser. Nos. 12/165,060 (Underwater Gun Comprising a Valve-Type Barrel-Seal), 12/165,066 (Underwater Gun Comprising a Barrel Adapter including a Barrel Seal), 12/165,071 (Underwater Gun Comprising a Plate-Type Barrel Seal), and 12/165,079 (Underwater Gun Comprising a Passive Fluidic Barrel Seal), all of which were filed on even date herewith and all of which are incorporated by reference herein.

FIELD OF THE INVENTION

The present invention relates to underwater guns.

BACKGROUND OF THE INVENTION

Underwater guns are useful as anti-mine and anti-torpedo devices. Recently, autonomous underwater vehicles (AUVs) have been fitted with underwater guns for torpedo defense and underwater "hunter-killer" CONOPs.

A gun, especially one with a high muzzle velocity, cannot be fired when water is in its barrel. If a firing where to incur in a water-filled barrel, a very high breach pressure would result as the ignited propellant charge forces (or tries to force) the water out of the barrel. The likely result would be material failure of the barrel.

The prior art is replete with approaches for waterproofing the barrel of an underwater gun, or for clearing water from its barrel before firing. U.S. Pat. No. 5,639,982 discloses a means for firing a fully automatic gun underwater using a blank barrel-clearance round. Blank barrel-clearance rounds are alternated with live rounds of ammunition. To begin the process, a blank barrel-clearance round is first detonated. This creates gas and steam within the chamber that forms a bubble at the muzzle end of the barrel, thereby displacing water from the chamber. A live round is then immediately fired. The process is repeated, whereby the subsequent detonation of a blank barrel-clearance round displaces any water that has re-entered the barrel subsequent to the firing of the live round.

U.S. Pat. No. 5,648,631 discloses a spooled tape seal for sealing the barrel of an underwater gun. The system includes a tap that covers the opening of the gun barrel and sprockets for advancing the tape across the opening. Hydrostatic pressure keeps the tape pressed to the end of the barrel to create an effective seal. When a bullet is fired, it perforates the tape. During this brief period of egress, the exhaust gases from combustion of the propellant charge keep water from entering the barrel. Almost immediately, a non-perforated portion of the tape is advanced by the sprockets to cover the barrel opening. External hydrostatic pressure re-seats the tape, thereby preventing water from entering the barrel.

U.S. Pat. No. 5,687,501 discloses a sealing plate for providing a watertight seal for a multi- or single-barreled underwater gun. The sealing plate provides one or more firing apertures in an otherwise solid surface. Between firings, the gun muzzle is sealed by a solid surface of the sealing plate. To fire a bullet, the sealing plate or muzzle rotates to align the gun muzzle with one of the firing apertures. This permits unimpeded egress. After the bullet fires, the plate or muzzle again rotates so that a solid portion of the sealing plate covers the muzzle.

These are but a few of the many patents pertaining to various aspects of underwater gun design in general, and to the water-in-the-barrel problem, in particular. Notwithstanding the many approaches to the problem, no truly satisfactory approach has been developed for keeping water out of the barrel of an underwater gun between and during operation.

SUMMARY OF THE INVENTION

The present invention provides an underwater gun having a barrel seal for preventing water from entering the barrel between the firing of rounds.

In the illustrative embodiment, the barrel seal comprises a turbine that is disposed near the muzzle end of the barrel of a gun. The spin axis of the turbine is coincident with the barrel of the gun (i.e., the turbine and the barrel are concentric). The turbine is driven by a motor. The motor's controller responds to commands from the gun's fire-control system.

In various embodiments, the turbine is configured and/or operated in different ways that ultimately determine how the barrel seal operates to keep water from entering the gun's barrel. In the embodiments described herein, the turbine remains spinning once a round is fired. This ensures that water is kept out of the barrel so that subsequent rounds can be fired.

In a first embodiment, the turbine comprises a plurality of radially-disposed turbine blades. When the turbine spins, the blades scoop water from the surroundings. This water is forced out of the turbine in the axial direction through a plurality of very small exit orifices, thereby generating a high pressure water jet. The pressure of this water jet is greater than the water pressure at the operating depth of the gun, such that the water jet prevents water from entering the barrel.

In a second embodiment, a supercavitating turbine is used. The supercavitating turbine has internal blades. When water contacts the blades of turbine during operation, the water is vaporized. Bubbles of water vapor accumulate near the centerline of the barrel due to the spin of the turbine. The barrel seal is effected by operating the turbine such that a steady-state condition is attained wherein the rate of water entry into the supercavitating turbine is equal to the volume of water vapor that is leaving the supercavitating turbine.

In a third embodiment, the turbine comprises a plurality of internal blades. A plurality of exit orifices are disposed in the side wall of the turbine. During operation, water is drawn into the turbine through an axially-disposed entrance orifice and expelled in a radial direction through the exit orifices.

In some embodiments, in particular the first embodiment discussed above, other types of rotating equipment can be used instead of a turbine. For example, and without limitation, a centrifugal pump can be used.

DETAILED DESCRIPTION

The terms appearing below are defined for use in this specification, including the appended claims, as follows:

- Axially-oriented (or axial orientation) refers to an orientation that aligns with the longitudinal axis of an element. This orientation is orthogonal to a radial orientation.
- Barrel is a narrow, hollow cylindrical portion of a firearm through which a bullet travels.
- Bore is the hollow portion of the barrel through which a bullet travels during its acceleration phase.
- Breech is an opening in the rear of a barrel of a gun where bullets can be loaded.
- Chamber is the portion of a barrel where a cartridge is placed just prior to being fired. This is a high pressure containment area which is very precisely aligned with the bore of the barrel.
- Fluidically coupled or fluidic communication means that liquid, gas, or vapor from a first region can flow to or otherwise cause an effect in a second region. For example, if two regions are fluidically coupled (or in fluidic communication), a pressure change in one of those regions might (but not necessarily will) result in a pressure change in the other of the regions.
- Muzzle is the end of the barrel where the bullet exits as it is being fired.
- Operatively coupled means that the operation of one device affects another device, wherein the devices need not be physical attached to one another. For example, a laser and a mirror are operatively coupled if a laser directs a beam of light to the mirror. An actuator and a valve are operatively coupled if the actuator actuates the valve. Operatively-coupled devices can be coupled through any medium (e.g., semiconductor, air, vacuum, water, copper, optical fiber, etc.) and involve any type of force. Consequently, operatively-coupled objects can be electrically-coupled, hydraulically-coupled, magnetically-coupled, mechanically-coupled, optically-coupled, pneumatically-coupled, thermally-coupled, etc.
- Radially-oriented (or radial orientation) refers to an orientation that is coincident with the radial direction of an element. See "axially-oriented."

The present invention pertains to guns that are intended for (1) use in an underwater environment and (2) firing rounds that include a chemical propellant. The underwater guns described herein will typically, although not necessarily, be fitted to AUVs. For clarity, gun 100 is typically depicted in the Figures as having a single round in the chamber or bore. It is to be understood, however, that gun 100 is typically a multi-shot weapon.

Figure 1A:
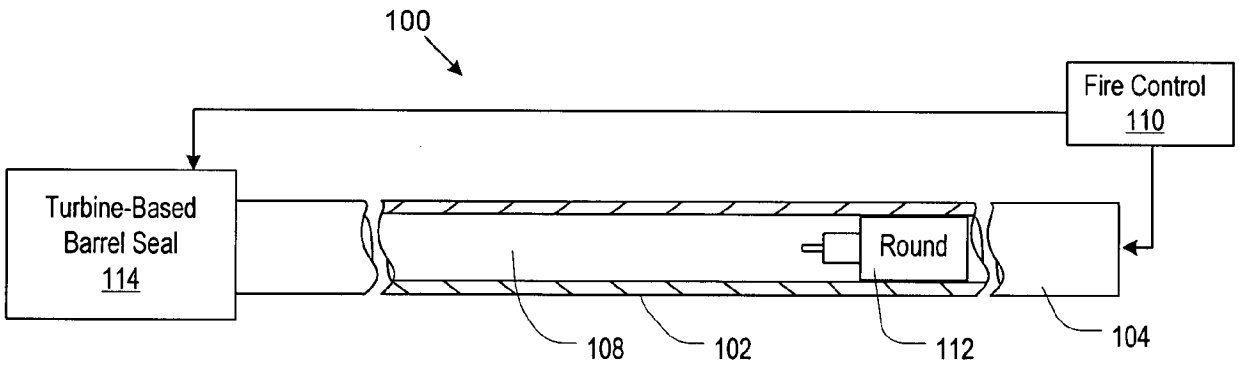
FIG. 1A depicts an underwater gun having a turbine-based barrel seal in accordance with the illustrative embodiment of the present invention.

FIG. 1A depicts underwater gun 100 having a turbine-based barrel seal in accordance with the illustrative embodiment of the present invention. Gun 100 includes barrel 102, chamber 104, bore 108, fire-control system 110, turbine-based barrel seal 114. A live round 112 is depicted in bore 108.

Figure 1B:
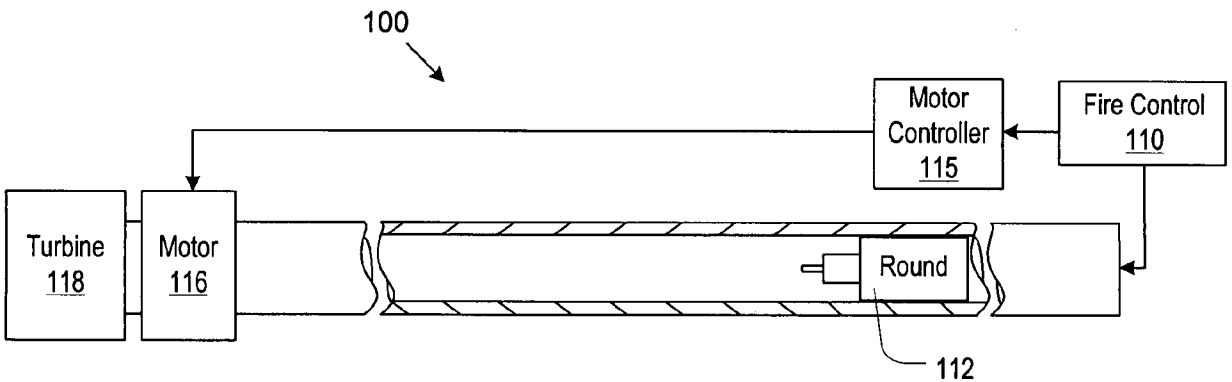
FIG. 1B depicts further detail of the turbine-based barrel seal of the underwater gun of FIG. 1A.

In the illustrative embodiment that is depicted in FIG. 1B, turbine-based barrel seal 114 comprises motor controller 115, motor 116, and turbine 118, interrelated as shown.

The barrel 102, chamber 104, and bore 108 are conventional features of most guns. Fire-control system 110 is basically a computer and ancillary elements that enable gun 100 to hit a target. The relative sophistication of any particular embodiment of fire-control system 110 is primarily a function of the intended application for gun 100. That is, a relatively more sophisticated fire-control system is required for a relatively more autonomous application (e.g., for use in conjunction with an AUV, etc.).

In a typical embodiment, fire-control system 110 interfaces with one or more sensors (e.g., sonar, radar, infra-red search and track, laser range-finders, water current, thermometers, etc.). The sensor input is used to develop a firing solution for a target. To the extent that gun 100 is located on an AUV, etc., fire-control system 110 advantageously takes into account movements of the AUV itself. And, when associated with an AUV, fire-control system 110 is operatively coupled to aiming and firing mechanisms.

The fire-control system is not particularly germane to an understanding of the invention and, furthermore, is well understood by those skilled in the art. As a consequence, fire-control system 110 will not be described in further detail.

Upon receiving an indication to fire round 112 from gun 100, fire-control system 110 sends a signal to motor controller 115 to energize motor 116. The motor is operatively connected to turbine 118 and spins the turbine to a desired angular velocity. As described further below in conjunction with three specific embodiments of turbine-based barrel seal 114, the turbine draws in water to function as a barrel seal. The way in which the water is used as a barrel seal varies, in the three specific embodiments, as a function of turbine configuration and operation.

This specification now proceeds with a description of three specific embodiments of a turbine-based based barrel seal of FIG. 1B for use in conjunction with underwater gun 100. The description and drawings showing those embodiments focus primarily on turbine 118 and its operation, since this is the primary distinction between the embodiments. It is understood, however, that various embodiments of gun 100 that are depicted in FIGS. 2-10 include elements such as fire-control system 110, motor controller 115, etc., which are depicted in FIGS. 1A and 1B, but not in FIGS. 2-10.

Figure 2:
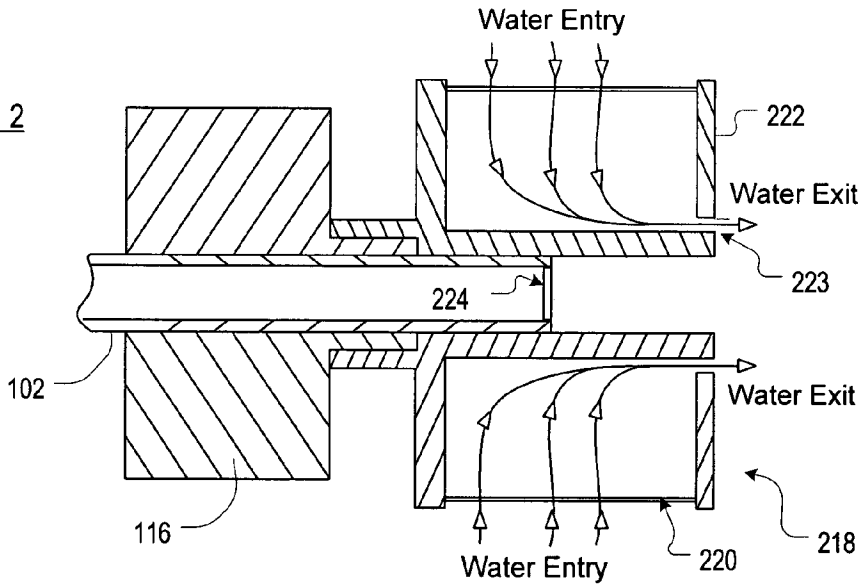
FIG. 2 depicts a cross-secional view of a first embodiment of the turbine-based barrel seal of FIG. 1B, wherein the turbine is configured and operated to draw water in along a radial direction and expel it along the axial direction as a high pressure water jet.
Figure 4:
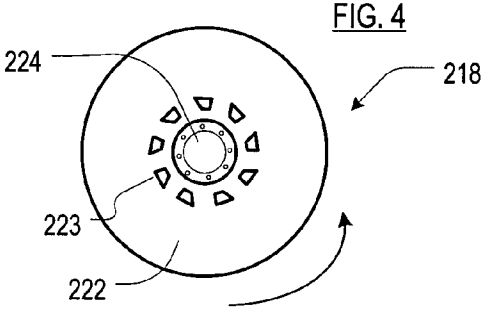
FIG. 4 depicts an end view of the first embodiment of the turbine-based barrel seal shown in FIG. 2.
Figure 3:
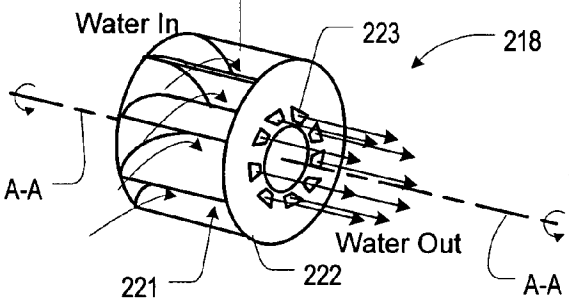
FIG. 3 depicts a perspective view of the first embodiment of the turbine-based barrel seal shown in FIG. 2.

FIGS. 2 through 4 depict a first embodiment of turbine-based barrel seal 114 of FIG. 1B. FIG. 2 depicts motor 116 and turbine 218 coupled to muzzle end of barrel 102. Rupture disk 224 is disposed at the end of barrel 102. FIG. 3 depicts a three-quarters perspective view of turbine 218 and FIG. 4 depicts a front end view of turbine 218.

Referring now to FIGS. 2 through 4, turbine 218 comprises a plurality of blades 220 that extend radially outward about spin axis A-A of the turbine. Blades 220 are curved to facilitate "scooping" water from the surroundings. Channel 221 is formed between adjacent turbine blades 220.

A plurality of orifices 223 are disposed in forward wall 222 of turbine 218, one orifice in each channel 221. Orifices 223 are situated at the most radially-inward portion of forward wall 222 (i.e., at the bottom of each channel 221). As a consequence, the diameter of the "ring" of orifices 223 is only slightly larger than the diameter of barrel 102.

Before gun 100 is initially fired, water is kept out of barrel 102 via rupture disk 224, which is disposed at the muzzle of barrel 102. Upon receiving a command to fire gun 100, fire-control system 110 sends a signal to motor controller 115 to energize motor 116 (see, FIG. 1B). The motor spins the turbine 218 up to a desired angular velocity before round 112 is fired.

Spinning turbine 218 draws in water between from the surroundings and expels it as a high-pressure water jet through orifices 223. The turbine is designed and operated so that the pressure of the water jetting through orifices 223 is greater than the ambient water pressure (based on the actual depth underwater of gun 100).

After the high-pressure water jet is established, round 112 is fired. Firing the round causes rupture disk 224 at the muzzle of barrel 102 to rupture. Rupture is due to the increase in pressure in bore 108. Turbine 218 continues to spin after the first round is fired so that the high-pressure water jet it creates keeps barrel 102 free of water after rupture disk 224 has ruptured. Additional rounds can be fired through the now water-free barrel (as long as turbine 218 is spinning).

Figure 5:
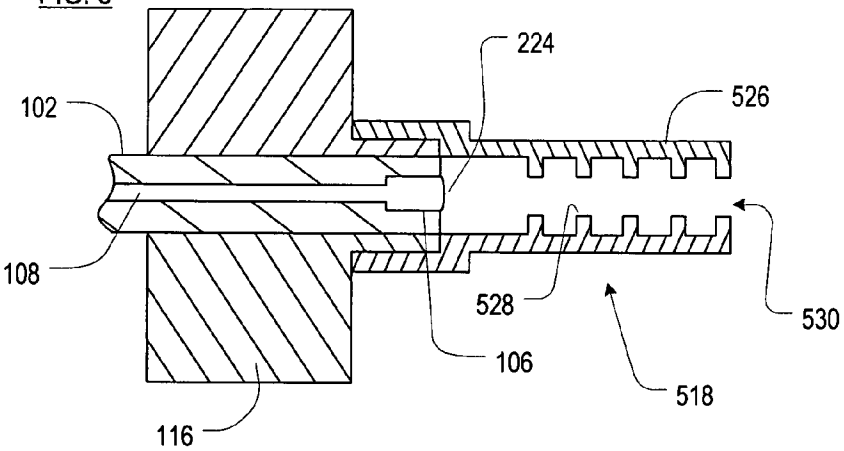
FIG. 5 depicts a cross-sectional view of a second embodiment of the turbine-based barrel seal of FIG. 1B, wherein the turbine is configured and operated to generate water vapor.
Figure 6:
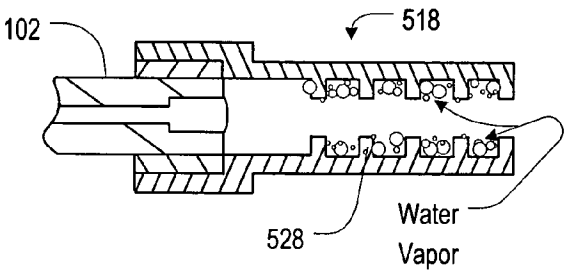
FIG. 6 depicts a cross-sectional view of turbine of the second embodiment of the turbine-based barrel seal shown in FIG. 5, wherein the turbine is shown in operation forming water vapor as water contacts the turbine blades.
Figure 7:
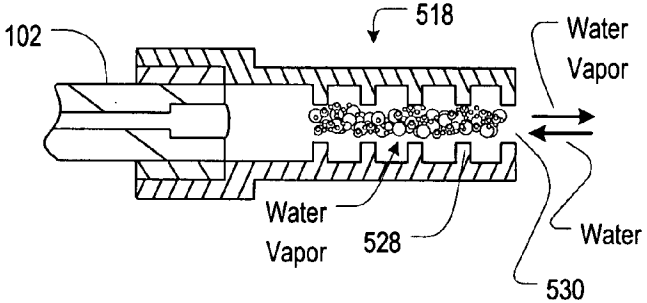
FIG. 7 depicts a cross-sectional view of turbine of FIG. 6, wherein the vapor bubbles that are formed migrate to the spin axis of the turbine and leave the turbine in equilibrium with water that enters the turbine.

FIGS. 5 through 7 depict a second embodiment of turbine-based barrel seal 114 of FIG. 1B. FIG. 5 depicts a cross-sectional view of motor 116 and turbine 518 coupled to muzzle end of barrel 102. Rupture disk 224 is disposed at the end of barrel 102. FIG. 6 depicts a cross-sectional view of turbine 518 in operation wherein water vapor forms as water contacts the turbine blades. FIG. 7 depicts a cross-sectional view of turbine 518 in operation, wherein the vapor bubbles that are formed migrate to the spin axis of the turbine and leave the turbine in equilibrium with water that enters the turbine.

Referring now to FIGS. 5 through 7, turbine 518 comprises a plurality of internally disposed turbine blades 528 that extend radially inward from wall 526.

In operation, turbine is spun up to a desired operating speed via motor 116. Water enters turbine 518 through orifice 530. The spin of the turbine 518 forces the water radially outward such that water contacts blades 528. The operating speed of turbine 518 is sufficient to cause supercavitation; that is, contact with the blades causes the water to vaporize, generating bubbles. The vapor bubbles propagate to spin axis due to the spin of the turbine.

To prevent water from entering barrel 102, a steady state condition is attained in which the rate of water entry into turbine 518 is equal to the volume of water vapor leaving orifice 530. The barrel seal is created by operating the turbine such that a steady-state condition is attained wherein the rate of water entry into the supercavitating turbine is equal to the volume of water vapor that is leaving the supercavitating turbine.

The rate at which water vapor is produced is a function the design of turbine blades 528, the length of turbine 518, and the angular velocity at which the turbine rotates. Those skilled in the art will be capable of designing and operating a turbine to vaporize water at a rate needed to achieve the aforementioned steady state condition.

As in the previous embodiment, turbine 518 is brought up to speed before gun 100 is fired. That is, upon receiving a command to fire gun 100, fire-control system 110 sends a signal to motor controller 115 to energize motor 116 (see, FIG. 1B). The motor spins the turbine 518 up to a desired angular velocity before round 112 is fired. Rupture disk 224 is used to keep barrel 102 dry before the first firing.

After the steady state condition is established, round 112 is fired. The round, and/or pressure from the combustion gases that are generated when the round's propellant charge is ignited), causes rupture disk 224 at the muzzle of barrel 102 to rupture. Turbine 518 continues to spin after the first round is fired so that barrel 102 is kept free of water after rupture disk 224 has ruptured. Additional rounds can be fired through the water-free barrel as long as turbine 518 is spinning.

Figure 8:
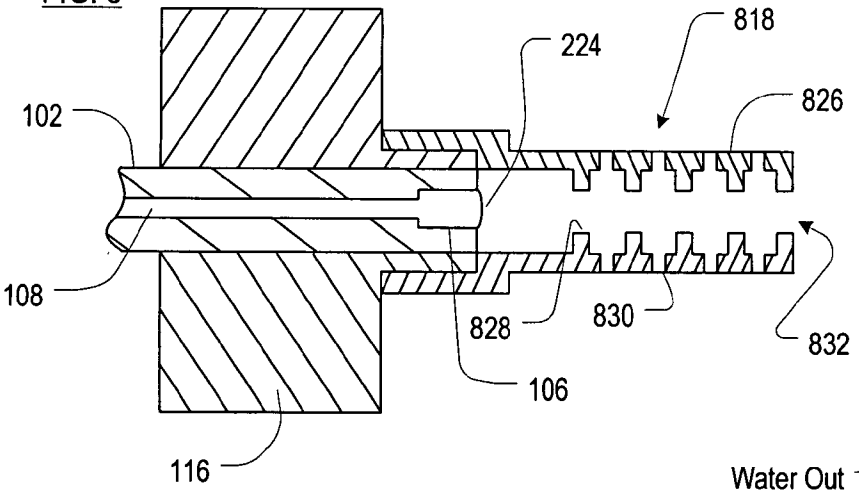
FIG. 8 depicts a cross-sectional view of a third embodiment of the turbine-based barrel seal of FIG. 1B, wherein the turbine is configured and operated to draw in water along the axial direction and expel it in a radial direction.
Figure 10:
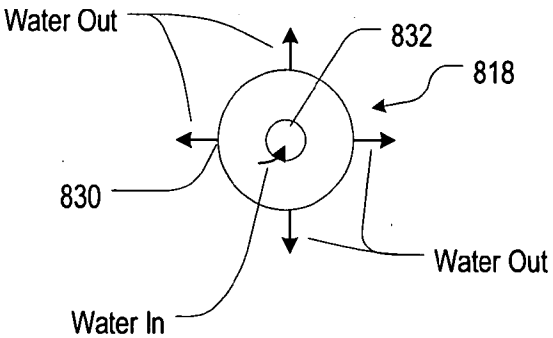
FIG. 10 depicts a front-end view of the turbine of FIG. 9 in operation.
Figure 9:
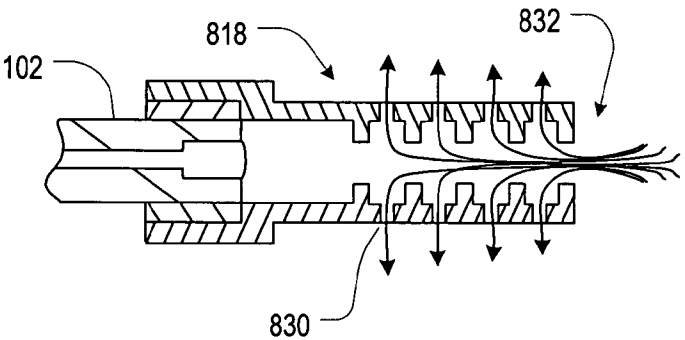
FIG. 9 depicts a cross-sectional view of turbine of the third embodiment of the turbine-based barrel seal shown in FIG. 8, wherein the turbine is shown in operation.

FIGS. 8 through 10 depict a third embodiment of turbine-based barrel seal 114 of FIG. 1B. FIG. 8 depicts a cross-sectional view of motor 116 and turbine 818 coupled to muzzle end 106 of barrel 102. Rupture disk 224 is disposed at the end of barrel 102. FIG. 9 depicts a cross-sectional view of turbine 818 in operation. FIG. 10 depicts a front end view of 818 in operation.

Referring now to FIGS. 8 through 10, turbine 818 comprises a plurality of internally-disposed turbine blades 828 that extend radially inward from wall 826. A plurality of orifices 830 are disposed in wall 826 between blades 828. In the embodiment that is depicted in these Figures, a grouping of four orifices 830 is disposed at ninety-degree intervals around wall 826 between successive blades 828 (see, FIG. 10). In some other embodiments, the grouping contains a different number of orifices 830 (e.g., 7, etc.) and in some additional embodiments, the groupings are disposed at different axial locations than is shown in FIGS. 8 and 9.

As in the previous embodiments, turbine 818 is brought up to speed before gun 100 is fired. Upon receiving a command to fire gun 100, fire-control system 110 sends a signal to motor controller 115 to energize motor 116 (see, FIG. 1B). The motor spins the turbine 818 up to a desired angular velocity before round 112 is fired. Rupture disk 224 is used to keep barrel 102 dry before the first firing.

The spinning turbine draws water in through orifice 832 and expels all such water through orifices 830. When round 112 is fired, the round, and/or pressure from the combustion gases that are generated when the round's propellant charge is ignited, causes rupture disk 224 at the muzzle of barrel 102 to rupture. Turbine 818 continues to spin after the first round is fired so that barrel 102 is kept free of water after rupture disk 224 has ruptured. Additional rounds can be fired through the water-free barrel as long as turbine 818 is spinning.

It is to be understood that the disclosure teaches just one example of the illustrative embodiment and that many variations of the invention can easily be devised by those skilled in the art after reading this disclosure and that the scope of the present invention is to be determined by the following claims.

What is claimed is:

1. An underwater gun, comprising:

a barrel, wherein the barrel has a muzzle and an axially-oriented first bore;

a turbine, wherein:

(a) the turbine is disposed at an outlet of the muzzle;

(b) the turbine has a spin axis that is co-axial with the first bore of the barrel; and (c) the turbine draws in water during operation; and a motor for driving the turbine, wherein the motor is coupled to the muzzle-end of the barrel.

2. The underwater gun of claim 1 further comprising a seal, wherein, when intact, the seal prevents water from entering the first bore, and further wherein the seal is capable of being ruptured when a round is fired from the gun.

3. The underwater gun of claim 2 wherein the seal is disposed proximal to the muzzle.

4. The underwater gun of claim 1 wherein the turbine comprises:

a plurality of radially-extending blades, wherein adjacent blades define a channel through which water is drawn into the turbine, wherein a mouth of each channel is defined by a first flow area; and a forward surface, wherein said forward surface comprises a plurality of orifices, one orifice per channel, and wherein one of the orifices is disposed proximal to a bottom of each channel, and wherein each orifice has a second flow area, and wherein the second flow area is smaller than the first flow area, and wherein the water that was draw in through the channels is expelled through the orifices.

5. The underwater gun of claim 1 wherein the turbine comprises:

a plurality of blades that are disposed within a turbine housing;

an orifice that is disposed along the spin axis of the turbine for drawing water into the turbine; and a plurality of ports disposed in the turbine housing at discrete locations along a length of the turbine housing, wherein water is ejected through the ports in a substantially radial direction.

6. The underwater gun of claim 1 wherein the turbine is operated in a supercavitating mode, wherein the comprises:

a plurality of blades that are disposed within a turbine housing;

an orifice that is disposed along the spin axis of the turbine for drawing water into the turbine; and wherein the turbine is rotated at a speed that is sufficient to cause water to vaporize when it contacts the blades.

7. An underwater gun comprising:

a barrel, wherein the barrel has a muzzle and an axially-oriented first bore;

a turbine, wherein the turbine is disposed proximal to the muzzle and has a forward surface comprising a plurality of orifices, and further wherein the turbine is physically configured and arranged so that:

(a) a spin axis of the turbine is co-axial with the first bore of the barrel;

(c) in operation, blades of the turbine draw water in through channels along a radial direction that is substantially perpendicular to the spin axis;

(d) water is expelled through the orifices; and a motor for driving the turbine.

8. The underwater gun of claim 7 further comprising a temporary seal, wherein the seal is disposed proximal to the muzzle, and further wherein the seal is capable of being ruptured when a round is fired from the underwater gun.

9. The underwater gun of claim 7 wherein each channel provides a greater area for flow of water than each orifice.

10. The underwater gun of claim 7 wherein the turbine is designed and operated so that, at an operating depth of the gun, a pressure of the water being expelled through the orifices is greater than ambient pressure.

11. An underwater gun comprising:

a barrel, wherein the barrel has a muzzle and an axially-oriented first bore;

a turbine, wherein the turbine is disposed proximal to the muzzle and wherein the turbine is physically configured and arranged so that:

(a) a spin axis of the turbine is co-axial with the first bore of the barrel;

(b) in operation, the turbine draws in water along its spin axis proximal to a forwardmost surface thereof; and a motor for driving the turbine.

12. The underwater gun of claim 11 and further wherein the turbine comprises a plurality of ports that are disposed along of length of the turbine, wherein water that is drawn into the turbine is expelled through the orifices in a substantially radial direction.

13. The underwater gun of claim 12 further comprising a temporary seal for sealing the barrel, wherein the seal is capable of being ruptured when a round is fired by the underwater gun.

14. The underwater gun of claim 11 wherein the turbine vaporizes the water.

15. A method for operating an underwater gun, the method comprising:

(a) spinning a turbine that is disposed at the end of a barrel of the underwater gun;

(b) drawing water into the spinning turbine;

(c) firing a first round from the underwater gun to rupture a temporary seal that prevents water from entering the barrel before the turbine is spinning; and (d) firing additional rounds.

16. The method of claim 15 wherein the operation of drawing water into the spinning turbine further comprises drawing water into the turbine via channels disposed along a length of the turbine.

17. The method of claim 15 further comprising the operation of expelling, through orifices disposed in a forward surface of the turbine, the water that was drawn into the turbine.

18. The method of claim 15 wherein the operation of drawing water into the spinning turbine further comprises drawing water into the turbine along a spin axis thereof.

19. The method of claim 18 further comprising the operation of expelling, along a substantially radial direction through a plurality of orifices that are disposed along of length of the turbine, water that was drawn into the turbine.

20. The method of claim 15 further comprising vaporizing the water that was drawn into the turbine.

* * * * *